US011368782B2

(12) United States Patent
Schrader et al.

(10) Patent No.: US 11,368,782 B2
(45) Date of Patent: Jun. 21, 2022

(54) SYSTEM AND METHOD FOR CONVERTING PASSIVE PROTECTORS TO ANR HEADPHONES OR COMMUNICATION HEADSETS

(71) Applicant: Light Speed Aviation, Inc., Lake Oswego, OR (US)

(72) Inventors: Allan Schrader, Lake Oswego, OR (US); Matthew Raymond Evonuk, Tualatin, OR (US)

(73) Assignee: Light Speed Aviation, Inc., Lake Oswego, OR (US)

( * ) Notice: Subject to any disclaimer, the term of this patent is extended or adjusted under 35 U.S.C. 154(b) by 648 days.

(21) Appl. No.: 15/427,624

(22) Filed: Feb. 8, 2017

(65) Prior Publication Data

US 2017/0230744 A1 Aug. 10, 2017

Related U.S. Application Data

(60) Provisional application No. 62/292,857, filed on Feb. 8, 2016.

(51) Int. Cl.
*H04R 1/10* (2006.01)
*G10K 11/178* (2006.01)

(52) U.S. Cl.
CPC ..... *H04R 1/1075* (2013.01); *G10K 11/17855* (2018.01); *G10K 11/17857* (2018.01); *G10K 11/17861* (2018.01); *G10K 11/17873* (2018.01); *H04R 1/1008* (2013.01); *H04R 1/1083* (2013.01); *G10K 2210/1081* (2013.01); *G10K 2210/3219* (2013.01); *H04R 2201/107* (2013.01); *H04R 2410/05* (2013.01); *H04R 2460/01* (2013.01)

(58) Field of Classification Search
CPC .. H04R 1/1008; H04R 1/1041; H04R 1/1075; H04R 1/1083; H04R 2201/107; H04R 2410/05; H04R 2460/01; G10K 11/178
USPC ..... 381/317, 318, 71.1, 71.6, 72, 74, 370, 381/371, 372, 373; 379/430
See application file for complete search history.

(56) References Cited

U.S. PATENT DOCUMENTS 5,182,774 A * 1/1993 Bourk ..... H04R 1/1083 379/430
5,241,971 A 9/1993 Lundin
6,597,792 B1 * 7/2003 Sapiejewski ..... H04R 1/1083 381/371

(Continued)

*Primary Examiner* — Huyen D Le
(74) *Attorney, Agent, or Firm* — Brooks Kushman PC

(57) ABSTRACT

A system and method for converting a passive protector earmuff to a communication and/or active noise reduction (ANR) headset include mounting active components to a frame subassembly configured for insertion into the passive earcup to divide the earcup volume into a front cavity without additional passive leak paths and a back cavity having a volume that improves speaker/driver power efficiency with a resistive vent to atmosphere. An earcup having an external shell includes a frame configured for positioning within the external shell and having a first support adapted to contact an interior of the shell and a second circumferential support cooperating with a seal to contact an ear seal plate of the earcup to form the front and back cavities. The frame may support a speaker between the front and back cavity, and secure circuitry within the back cavity.

6 Claims, 2 Drawing Sheets

(56) References Cited

U.S. PATENT DOCUMENTS

| | | | | |
|---|---|---|---|---|
| 6,735,316 | B1 | 5/2004 | Wurtz | |
| 7,317,802 | B2 | 1/2008 | Wurtz | |
| 2006/0013410 | A1* | 1/2006 | Wurtz | H04R 1/1033 381/74 |
| 2013/0329902 | A1* | 12/2013 | Bakalos | G10K 11/178 381/71.8 |

* cited by examiner

SYSTEM AND METHOD FOR CONVERTING PASSIVE PROTECTORS TO ANR HEADPHONES OR COMMUNICATION HEADSETS

CROSS-REFERENCE TO RELATED APPLICATIONS

This application claims the benefit of U.S. provisional application Ser. No. 62/292,857 filed Feb. 8, 2016, the disclosure of which is hereby incorporated in its entirety by reference herein.

TECHNICAL FIELD

This disclosure relates to a system and method for converting passive ear muff protectors to an over-the-ear headset or headphones that may include active and passive noise reduction and audio communication technology.

BACKGROUND

Passive hearing protection may include two earcups or muffs joined by a headband and worn over ears of users to enhance or protect hearing. Active and passive attenuation may be provided to protect hearing, reduce loudness of ambient noise, and improve user hearing of desired sounds. Both active and passive attenuation vary as a function of frequency. Various strategies have been developed to provide desired attenuation across frequency ranges of interest. Passive attenuation may be improved by reducing noise leak paths into the ear. However, there are design compromises between user comfort and pressure of the earcups to reduce leak paths. As such, performance can vary from person to person based on how well the earcups fit the head of a user. Significant research and development resources have been expended to engineer and design ear muff shapes and select materials that provide desired performance with respect to passive attenuation, weight, and comfort.

SUMMARY

In various embodiments, a modular insert for an ear muff having an external shell includes a frame configured for positioning within the external shell and having a first support adapted to contact an interior of the external shell and a second circumferential support cooperating with a seal to contact an ear seal plate of the ear muff to define a back cavity between the interior of the shell and the frame and a front cavity between the frame and a user's head. The frame may include an aperture configured to receive a speaker supported by the frame between the front cavity and the back cavity, and supports to secure circuitry coupled to the speaker within the back cavity. The external shell may include or may be modified to include a resistive vent that vents the back cavity to atmosphere.

The modular insert may be used to convert ear muffs to a communication headset which may include a boom microphone. Alternatively, a wired microphone or wireless microphone may be coupled to circuitry on the modular insert. Active noise reduction (ANR) circuitry components may also be provided. For ANR applications, the frame may be configured to support a sense microphone coupled to the circuitry to provide (ANR) operation using the speaker. The resistive vent may include an integrated ambient microphone coupled to the circuitry to provide a feedforward signal for use by the ANR control system. The frame may also be configured to support one or more rechargeable batteries within the back cavity to power the circuitry. The circuitry may include a wired or wireless transceiver to send and receive audio and voice signals using various technologies and protocols, such as Wi-Fi, Bluetooth, Wi-Max, etc.

Embodiments according to the disclosure may provide one or more associated advantages. For example, inserts according to the disclosure leverage previous research and development of ear muffs that provide desirable passive attenuation for conversion to communication headsets or ANR headsets. The components and circuitry for wired or wireless communication or ANR headsets can be mounted to an insertable frame installed within the ear muffs that provides a sealed front cavity to maintain or improve desirable passive attenuation characteristics. Similarly, passive attenuation performance may be maintained by connection of any components that require an external wire or other connection, such as a boom microphone or ambient microphone, through the earmuff external shell into the back cavity. The modular characteristics of the insertable frame may reduce part counts and provide manufacturing flexibility for multiple models of communication and ANR headsets using existing muff/earcup designs and associated existing tooling. Frame shape and positioning may be selected to provide a desired volumetric or other ratio between the back cavity and the front cavity to improve speaker/driver power efficiency and resulting battery life associated with a relatively large back cavity volume. Circuitry installed on the modular frame insert may be tested to assure desired performance prior to assembly within the muffs.

The above advantages and other features and advantages may be recognized by those of ordinary skill in the art based on the following detailed description and accompanying drawings of one or more representative embodiments.

DETAILED DESCRIPTION

As required, detailed embodiments are disclosed herein; however, it is to be understood that the disclosed embodiments are merely representative and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the claimed subject matter.

Figure 1:
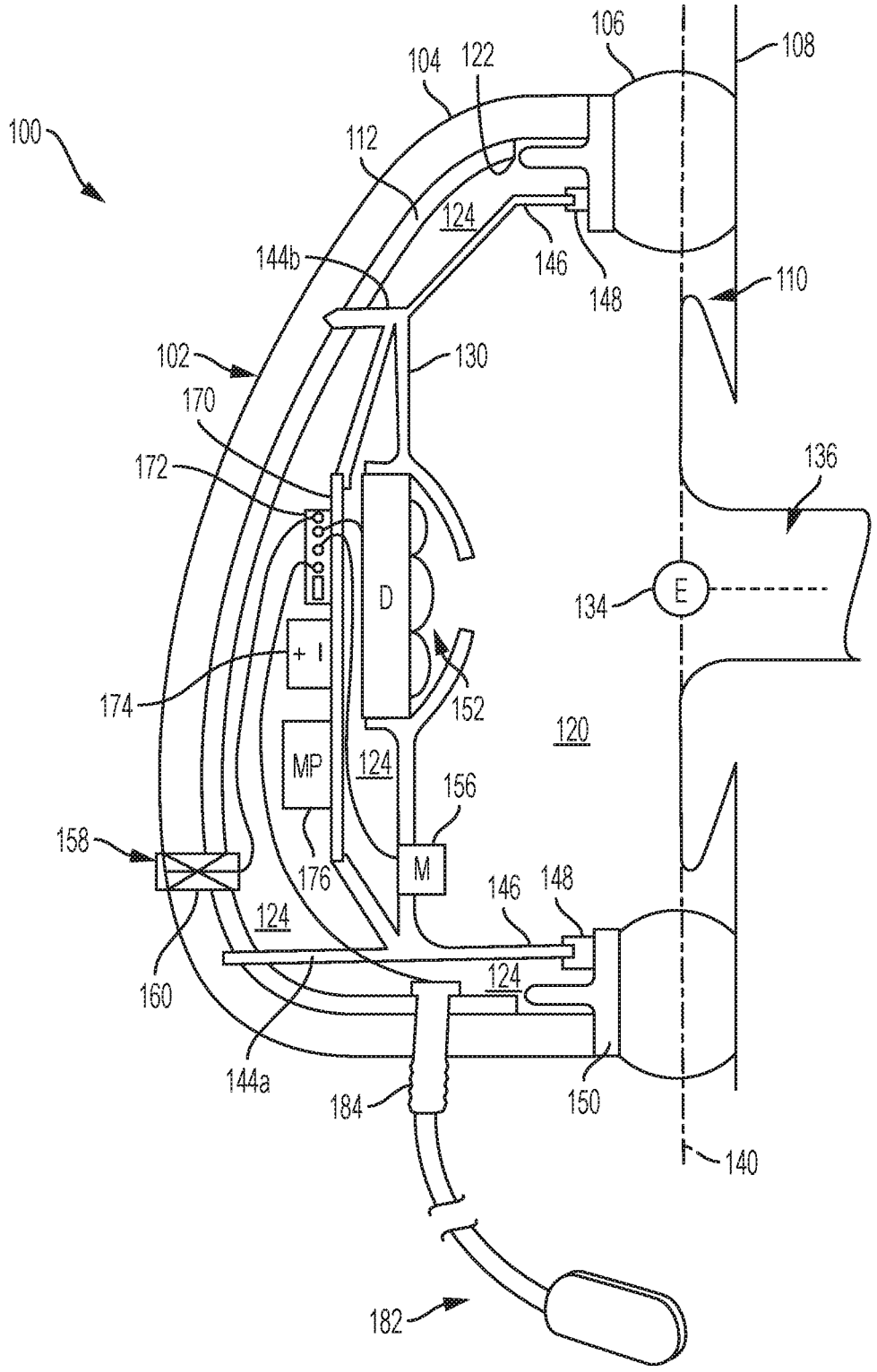
FIG. 1 is a cross-sectional view illustrating a representative embodiment of a system or method for converting a passive protector to ANR headphones or a communication headset.

FIG. 1 is a diagram illustrating a passive ear muff after conversion to a communication headset that may include active noise reduction. System 100 includes a pair of ear cups 102 (only one of which is shown) connected by a headband (not shown) or other connecting bridge member that holds ear cups 102 in position when worn by a user. A headband or bridge member may be positioned over the head, behind the head, under the chin, etc. In various embodiments, the ear cups 102 are secured to a head protecting safety device such as a helmet or hardhat for example. Each ear cup 102 includes a shell 104 having a cushion 106 around the periphery of a front opening that forms a seal against head 108 of a user and generally surrounds the pinna of the user's ear 110. Depending on the particular application and implementation, shell 104 may include a membrane or layer 112 of material selected to provide additional passive attenuation and/or desired structural characteristics for ear cup 104. The ear muff may include layer 112 prior to conversion to a communication headset, or layer 112 may be installed during the conversion/assembly process. Cushion 106 may be made of various types of materials that may have an associated compliance characteristic selected for a particular application to reduce or eliminate acoustic leak paths and provide a sealed chamber or cavity 120 surrounding ear 110. For example, cushion 106 may be manufactured from a viscoelastic material or foam and may include an additional covering or skin (not shown) to enhance durability, comfort, aesthetics, or various other system characteristics.

Prior to conversion according to embodiments of the present disclosure, cavity 120 is typically the only acoustic chamber or cavity within each shell 104 and extends from the user's head 108 to the interior 122 of shell 104. As described in greater detail below, after conversion, cavity 120 is divided into two separate cavities 120, 124 by an insertable frame 130 secured within shell 104. After frame 130 is installed, a first cavity 120 (also referred to as a front chamber or front cavity) extends from the user's head 108 to frame 130, and a second cavity 124 (also referred to as a back chamber or back cavity) extends from frame 130 to shell 104.

An ear sense reference point or region 134 may be defined for purposes of design, analysis, and evaluation to be just in front of the opening of ear canal 136. For experimental verification of the operation of system 100, an ear sense microphone (not shown) may be positioned within ear sense region 134, although typically not included in any commercial product. In the illustrated embodiment, ear sense point or region 134 may be located along the plane 140 passing through the compression centroid of cushion 106 and generally concentrically aligned with ear canal 136.

In the embodiment illustrated in FIG. 1, insertable frame 130 includes one or more support arms 144*a*, 144*b* that support frame 130 against shell 104. In one embodiment, shell 104 may have depressions or slots molded or machined into interior surface 122 that cooperate with support arms 144*a*, 144*b*. Similarly, acoustic layer or membrane 112 may include corresponding holes to accommodate support arms 144*a*, 144*b*. Frame 130 may also include a circumferential support arm 146 that cooperates with a gasket or seal 148 to seal against ear seal plate 150 and separate front cavity 120 from back cavity 124. This attempts to maintain or minimally affect the passive attenuation characteristics of the passive protector muff by avoiding introduction of additional leak paths associated with conversion of the muff from a passive headset to a communication headset or ANR headphones as described in greater detail herein.

As also illustrated in FIG. 1, frame 130 may include an aperture configured to receive a speaker 152, which may also be referred to as a driver, particularly in ANR headphones and headset applications. Speaker/driver 152 provides audio output for communication headsets based on communication signals received from a wired and/or wireless connection or communication link. For headphones or headsets having ANR features, frame 130 may also be configured to receive a sense microphone 156. To provide ANR functionality, speaker/driver 152 receives a combined signal representing audio/communication signals in addition to a noise reduction or noise cancelling signal that is opposite phase and similar amplitude of noise detected by a sense microphone 156 as generally understood by those of ordinary skill in the art. The noise reduction signal may also be based on input from an ambient microphone 158 that may be used as a feed forward signal in the ANR control system to further improve ANR performance. In one embodiment, ambient microphone 158 is integrated within a resistive vent 160 that provides resistive venting of back cavity 124 to atmosphere while providing a path for a wired connection between ambient microphone 158 and corresponding processing circuitry mounted on circuit board 170 and secured to frame 130. The opening for the integrated ambient microphone 158 and resistive vent 160 may be molded (and plugged) or machined through shell 104 during the conversion process.

In various embodiments, ambient microphone 158 may be separate from any resistive vent 160. Positioning of ambient microphone 158 may vary based on the particular application and availability of existing apertures in shell 104. Ambient microphone 158 should be positioned to minimize any feedback from speaker/driver 152. Ambient microphone 158 may be positioned close to resistive vent 160 so that a single aperture may be used to reduce sealing requirements and leak paths for noise.

The ambient microphone 158 may also be used to enhance situational awareness of the wearer by transmitting sounds having predetermined characteristics to speaker/driver 152, such as those associated with human speech or a warning siren or horn, for example. The predetermined characteristics may be associated with frequency and/or amplitude of the sounds desired to be transmitted to speaker/driver 152, for example.

Circuit board 170 may include various passive and active, analog and digital, electric and electronic components or modules such as an electrical connector 172, a rechargeable (or replaceable) battery 174 and a microprocessor or microcomputer 176 to provide various communication and/or ANR processing functions for operation of speaker/driver 152, sense microphone 156, ambient microphone 158, and microphone 182 (implemented by a boom microphone in the representative embodiment, but generally representing any wired or wireless microphone) depending on the particular application and implementation. Microphone 182 may be implemented by a comparative digital microphone signal solution, a throat microphone input, or an in-ear microphone that senses pressure differential from jaw movement, for example. Components or modules may include a wireless transceiver to wirelessly receive and transmit audio and voice signals using various technology, such as Bluetooth or Wi-Fi, for example. The particular components or modules may vary depending on the desired features. However, those of ordinary skill in the art will recognize that various components can be assembled and connected on or to circuit board 170 prior to mounting circuit board 170 to frame 130. During the conversion process, other components mounted to earcup 102 may be connected via connector 172 or similar connections to circuit board 170 prior to inserting and securing frame 130 within shell 104.

To convert the passive protector headset to a communication headset, microphone 182 may be added. A strain relief connection 184 may be inserted through a corresponding hole molded (and previously plugged) or machined through shell 104 during the conversion assembly process. Microphone 182 may then be electrically connected to circuit board 170 using connector 172. Alternatively, a wireless microphone may be coupled to processor 176 or similar circuitry via a Bluetooth, Wi-Fi, or other wireless communication link.

As generally illustrated in FIG. 1, the conversion process according to the illustrated embodiment minimizes or eliminates adding any leak paths that may degrade passive attenuation performance by positioning added components that require penetration through shell 104 within the area of shell 104 that defines the back cavity 124. As such, no additional leak paths are added to front cavity 120 during the conversion process. Furthermore, selective positioning of frame 130 within shell 104 may be used to provide a relatively large back cavity to improve power efficiency of the speaker/driver and resulting battery life. Similarly, the dual cavities created by the sealed frame may improve passive attenuation relative to the single cavity of the passive protector.

Those of ordinary skill in the art will recognize that frame 130 may be implemented in a variety of different forms consistent with the teachings of the disclosure to provide a modular insert having various components mounted thereto, including processing circuitry and a connector to connect one or more components mounted within earcup 102 while dividing the initial cavity within shell 104 into two separate cavities 120, 124. For example, frame 130 can be shaped so that circumferential support 146 and seal 148 seal against interior surface 122 of shell 104 rather than against ear seal plate 150. In various embodiments, shell 104 and/or frame 130 may be configured for insertion and retention by a helmet, hard hat, or other protective head gear. Similarly, various embodiments may include an unremovable ear seal plate. Frame 130 may be made of a resilient, flexible material so that it can be easily inserted within the opening formed by cushion 106. Alternatively, seal plate 150 and cushion 106 may be removed from shell 104 to facilitate insertion of frame 130 (and mounted components), and then replaced to secure frame 130 within shell 104. The shape of frame 130 may vary to provide a desired volumetric or similar ratio between front cavity 120 and rear cavity 124. Power efficiency of speaker/driver 152 may be improved by forming a relative large back cavity 124 so that the diaphragm of speaker/driver 152 may more easily vibrate and return to a neutral position. Resistive vent 160 may be tuned to balance the power efficiency and acoustic performance of speaker/driver 152. For ANR applications, the larger back cavity 124 and associated resistive vent 160 may also increase control system headroom.

Figure 2:
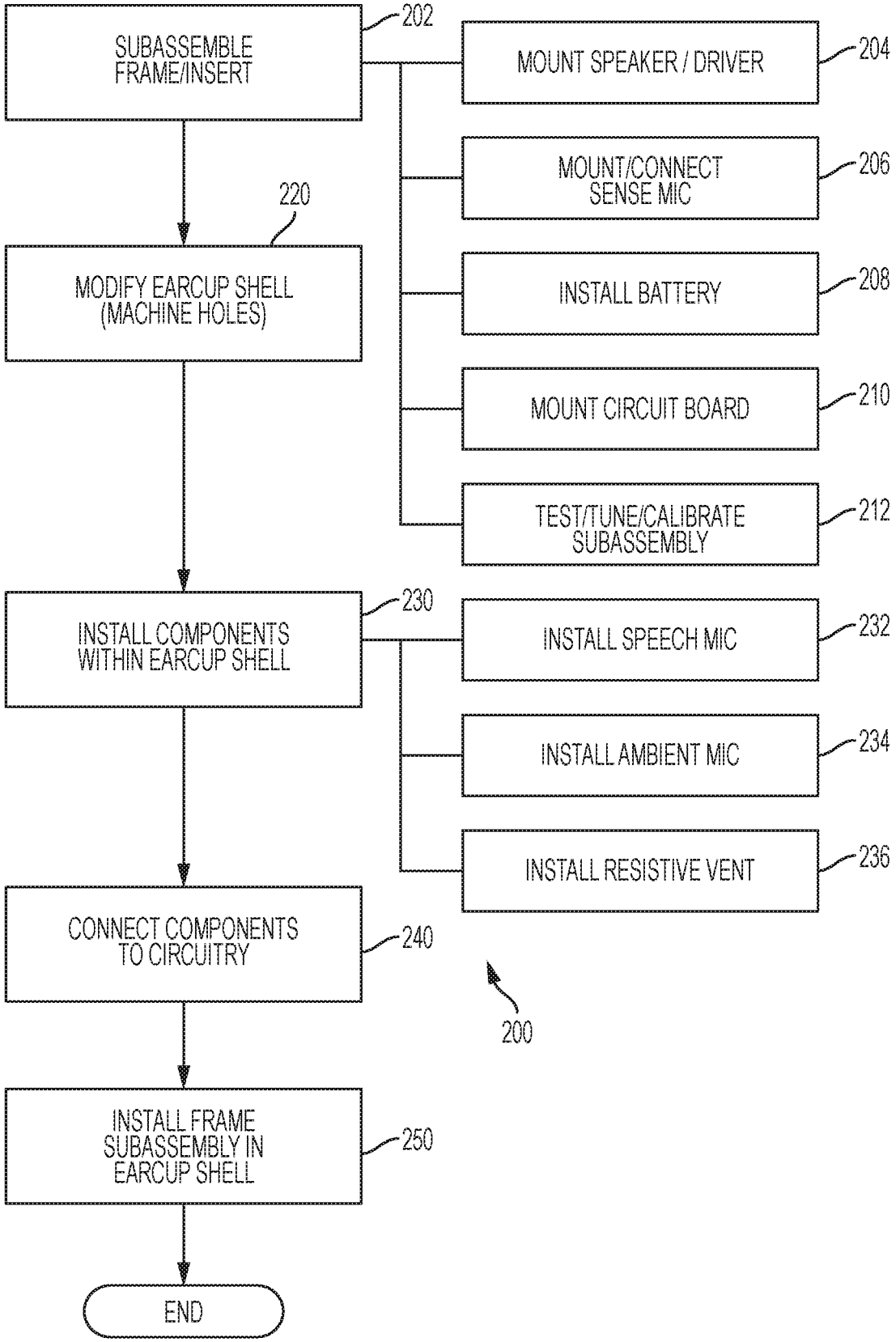
FIG. 2 is a flowchart illustrating a method for converting a passive protector to ANR headphones or a communication headset.

FIG. 2 is a flowchart illustrating a process for converting a passive protector to a communication headset or ANR headphones according to a representative embodiment. Those of ordinary skill in the art will recognize that the order of operations illustrated and described with respect to the flowchart may not necessarily be important to the process or be required to achieve the desired features and advantages. Similarly, all illustrated processes may not be required, and/or omitted processes apparent to those of ordinary skill that may be required may not be illustrated or described for ease of description and illustration. The conversion process may be performed by a manufacturer during initial assembly of the headset or headphones to convert earcups molded for passive protectors for use with communication headsets (which may include a speech microphone, ambient microphone, and/or wirelessly linked components, and may also include ANR features) or ANR headphones (which may not include a speech microphone or ambient microphone). This provides manufacturing flexibility using more common earcups for both passive protectors and active headsets, which may lead to reduced parts inventory, tooling costs, etc. Aftermarket applications may also be possible using a conversion kit.

With reference to FIGS. 1 and 2, process 200 may begin with subassembly of an insert or frame (130) as represented at 202. The particular design of the insert or frame and the selection and subassembly of components may vary depending on the particular model and features provided in the resulting converted product. Subassembly as represented at 202 may include mounting of a speaker/driver (152) as represented at 204, mounting and connection of a sense microphone (160) as represented at 206, installation of a battery (174) as represented at 208, mounting of a circuit board (170) or similar processing circuitry that may include a microprocessor or microcomputer (176) or other integrated circuits as represented at 210, etc. The subassembly may be tuned, calibrated, and/or tested for desired performance as represented at 212.

The conversion process may continue with modification of the shell (104) of the earcup (102) as represented at 220. Particular modifications will vary based on the selected features and whether the passive protector earcups being converted include any molded features to facilitate conversion (such as orientation/retention slots or pins, blind holes, or plugged holes, for example). As such, block 220 may include machining of holes or features within or through the shell (104).

The conversion process continues with installation of any added components within or through the shell (104) as represented at 230. This may include installation of a speech microphone (182) as represented at 232, a resistive vent (160) as represented at 234, and/or an ambient microphone (158) as represented at 236, for example. As previously described, an integrated ambient microphone and resistive vent may be used. Alternatively, the ambient microphone and resistive vent may be installed in separate locations. However, use of a common aperture may reduce sealing requirements and minimize leak paths as previously described.

Any components installed at 230 that use wired connections for signaling and/or power may be connected to the circuit board or other connector mounted to the frame subassembly as represented at 240. The frame subassembly is then installed and secured within the earcup as represented at 250. This may include positioning of the subassembly through the opening of the ear cushion to secure the frame within the earcup shell. The frame may be secured through tension of the frame or resilient seal, using adhesive, or through any other method depending on whether the frame subassembly is intended to be removable or permanently fixed within the earcup shell. Alternatively, the frame subassembly may be installed within the shell prior to installation of an ear seal plate (150) and cushion (106). The frame subassembly may be retained or held in place by tension from the ear seal plate in some embodiments.

While representative embodiments are described above, it is not intended that these embodiments describe all possible forms of the claimed subject matter. The words used in the specification are words of description rather than limitation, and it is understood that various changes may be made without departing from the spirit and scope of the claimed subject matter. Additionally, the features of various implementing embodiments may be combined to form further embodiments that may not be explicitly described or illustrated.

What is claimed is:

1. A headset comprising:

a circumaural earcup having a shell;

an acoustic damping membrane positioned on an interior surface of the shell;

a frame positioned within the shell to separate an interior volume of the shell into a back cavity between the frame and the shell and front cavity sealed from the back cavity, the frame configured to receive: a speaker extending between the front and back cavity, and processing circuitry in the back cavity; and a communication microphone coupled to the processing circuitry.

2. The headset of claim 1 further comprising a sense microphone mounted to the frame and coupled to the processing circuitry.

3. The headset of claim 2 further comprising a resistive vent coupling the back cavity to atmosphere.

4. The headset of claim 3 further comprising an ambient microphone coupled to the processing circuitry.

5. The headset of claim 4 wherein the ambient microphone is integrated with the resistive vent and coupled to the processing circuitry.

6. The headset of claim 4 wherein the processing circuitry generates an ANR signal based on signals from the sense microphone and the ambient microphone and outputs the ANR signal to the speaker.

* * * * *